United States Patent [19]

Ball

[11] Patent Number: 4,487,000

[45] Date of Patent: Dec. 11, 1984

[54] METAL REINFORCING STRIPS

[75] Inventor: Anthony F. Ball, Huddersfield, England

[73] Assignee: Tinsley Wire (Sheffield) Limited, England

[21] Appl. No.: 368,669

[22] Filed: Apr. 15, 1982

[30] Foreign Application Priority Data

Apr. 21, 1981 [GB] United Kingdom ..... 8112252

[51] Int. Cl.[3] ..... E04C 2/42

[52] U.S. Cl. ..... 52/660; 52/662; 52/664; 428/36; 428/52; 428/256; 428/222

[58] Field of Search ..... 52/660, 664, 662; 256/5, 45, 21, 37; 245/8; 428/36, 52, 222, 256

[56] References Cited

U.S. PATENT DOCUMENTS

| | | | |
|---|---|---|---|
| 302,845 | 7/1884 | Hulbert | 245/8 |
| 880,820 | 3/1908 | Pierson | 52/670 |
| 945,949 | 1/1910 | Higgins | 52/660 |
| 1,859,831 | 5/1932 | Land | 245/8 |
| 1,922,269 | 8/1933 | Wickwire | 52/660 |
| 3,109,349 | 11/1963 | Lorig | 52/660 |
| 3,249,686 | 5/1966 | Paar | 245/8 |
| 3,761,557 | 9/1973 | Werner . | |
| 4,081,159 | 3/1978 | Baldwin . | |
| 4,154,429 | 5/1979 | Brannan | 245/8 |

FOREIGN PATENT DOCUMENTS

| | | | |
|---|---|---|---|
| 41521 | 3/1910 | Austria | 52/660 |
| 4671 | of 1901 | United Kingdom | 52/660 |
| 836461 | 6/1960 | United Kingdom | 245/8 |
| 1494515 | 12/1977 | United Kingdom . | |

*Primary Examiner*—Henry E. Raduazo

*Attorney, Agent, or Firm*—King, Liles and Schickli

[57] ABSTRACT

A reinforcing strip for a concrete coating for oil or gas pipes consists of wires (1) welded together to form four-sided meshes (2) inclined to the length of the strip, and a straight selvedge wire (4) welded thereto to form along only one edge of the strip triangular meshes (6) incapable of being elongated by tension applied in a pipe coating and winding machine. The four-sided meshes (3) may be diamond-shaped with longer diagonals (7) longitudinal or transverse, or they may be squares. Welded mesh may be used or zig-zag wires welded to each other at adjacent peaks (9) and troughs (10) which may be interengaged or merely overlapped, and the zig-zags may extend longitudinally or transversely.

15 Claims, 12 Drawing Figures

METAL REINFORCING STRIPS

This invention relates to metal reinforcing strips for use in reinforcing concrete coatings on oil and gas pipes, for example, to counteract their buoyancy underwater and to withstand the pressures encountered in use.

As a concrete coating is applied to a pipe as it rotates and moves axially past a spraying station the concrete builds up as a frustoconical shape leading to a cylindrical shape, and a reinforcing strip is applied to the frustoconical region so as to be embedded in the concrete, so the edge of the strip nearest the direction in which the pipe is moving axially must surround a larger circumference than the other edge.

It is known from U.S. Pat. No. 3,761,557 to form a reinforcing strip with two or more longitudinal wires having spaced apart lateral wires welded thereto, one of the longitudinal wires (or all but one of the longitudinal wires) being provided with a degree of slack (for example, by crimps between each pair of lateral wires) to allow it (or them) to extend when wrapped around the frustoconical part of a concrete coating undergoing formation. Such a strip is difficult to manufacture since the slack in the (or each) extendable longitudinal wire must be introduced before the lateral wires are welded thereto.

It is therefore also known from U.K. Pat. No. 1,494,515 to form a reinforcement strip as a welded mesh having longitudinal wires and transverse wires, with all the longitudinal wires subsequently deformed to an equal extent, as by crimping them out of the general plane of the mesh between a pair of rollers, relying upon a differential straightening of the longitudinal wires as between one edge and the other to enable the strip to be wound on to the frustoconical part of a concrete coating undergoing formation. The problem with this strip is that the crimps make it difficult to roll the strip compactly on a reel for transporting from the factory to the pipe spraying station.

Accordingly, it is also known from U.K. Pat. No. 1,549,775 to form a reinforcement strip as a twisted wire netting with a straight selvedge wire along one longitudinal edge only and with a crimped line wire extending through at least one longitudinal line of twists remote from the selvedge wire, so as to control the amount of stretch permitted by the generally hexagonal meshes differentially from the selvedge wire to theremote line of meshes. The disadvantage of this strip is the limited diameter of wire that can be formed into twisted netting, which limits the weight (and, therefore—to some extent—the strength) of reinforcement, even though some increase can be obtained by doubling the selvedge wire and/or providing crimped line wires through some or all of the remaining lines of twists.

The object of the invention is to provide a reinforcing strip for use in a concrete coating on an oil or gas pipe that does not have the disadvantages or limitations of the known types referred to above.

According to the present invention, a reinforcing strip comprises wires welded together to form four-sided meshes having sides inclined to the longitudinal direction of the strip, and a straight selvedge wire welded thereto to form along only one edge of the strip triangular meshes incapable of being elongated by tension in the longitudinal direction of the strip.

The four-sided meshes may be diamond-shaped with their longer diagonals disposed respectively longitudinally or transversely of the strip or may be squares, but in any case the meshes can elongate differentially from those adjacent the triangular meshes to those adjacent the zig-zag edge remote from the selvedge wire.

The use of a welded mesh (or, in other words, a mesh without twists) enables any diameter of wire to be employed. However, the wires forming the four-sided meshes may themselves be formed as zig-zags and welded to each other at adjacent peaks and troughs. The zig-zags may extend longitudinally of the strip or transversely, and in the case of the latter disposition the zig-zags may be formed as flattened helices and interengaged (as in chain link fencing) before welding adjacent peaks and troughs and welding to the selvedge wire, but—because of the welding together of all the wires—it is generally convenient to use zig-zags formed in one plane, preferably with adjacent peaks and troughs overlapping slightly, so as to facilitate flash welding, and with a longitudinal disposition of the zig-zags the selvedge wire can overlap or be overlapped by the adjacent peaks (or troughs).

The selvedge wire may be of a different diameter (larger or smaller) to that of the wires forming the four-sided meshes.

The wires forming the meshes may be of different diameters, e.g., smaller diameter wire for wires remote from the selvedge wire, so as to reduce the pull required in the pipe coating and winding machine to stretch the meshes in the lengthwise direction of the strip to progressively greater extents from the selvedge wire to the other edge of the strip.

A strip in accordance with the invention, and of any of the forms described above, may be formed on site just in advance of the pipe coating machine, or it may be performed in a factory and rolled up into coils for storage and transport, and two preformed strips may be formed simultaneously by producing a double-width mesh with a selvedge wire along each longitudinal edge and then cutting the mesh in two longitudinally.

A number of embodiments of the invention will now be described, by way of example only, with reference to the accompanying diagrammatic drawings, in which.

Figure 1:
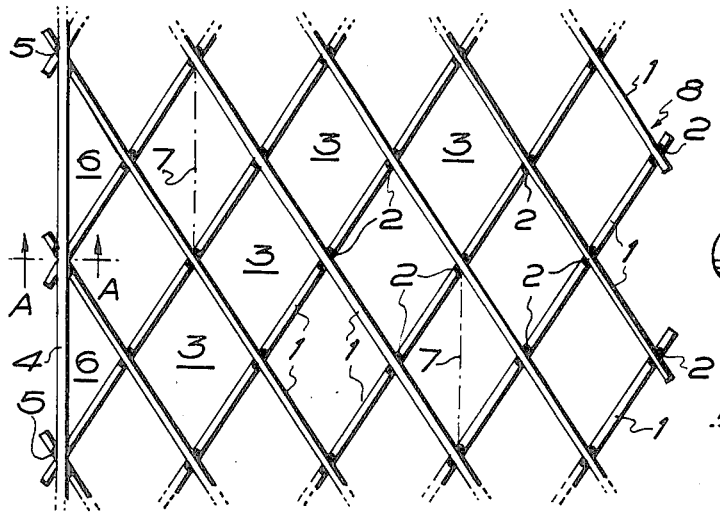
FIG. 1 is an elevation of a short length of reinforcing strip in accordance with the invention formed by welding together straight wires.
Figure 3:
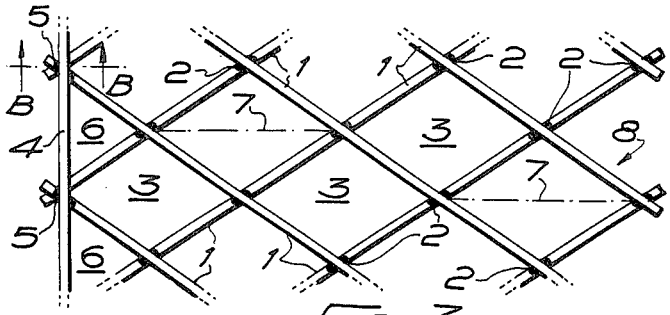
Figure 4:
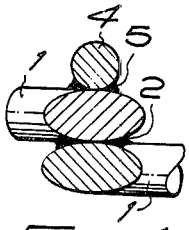
Figure 5:
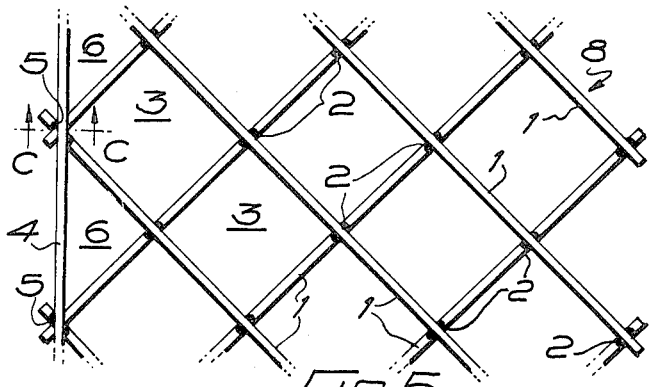
Figure 6:
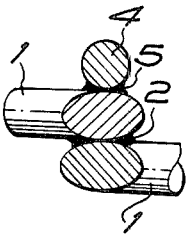
Figure 7:
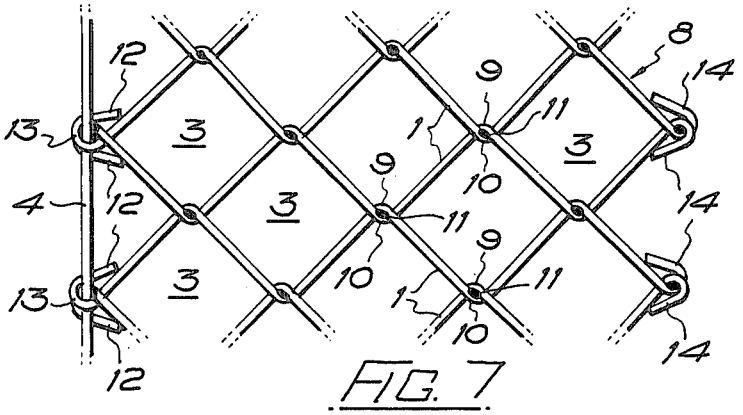
Figure 8:
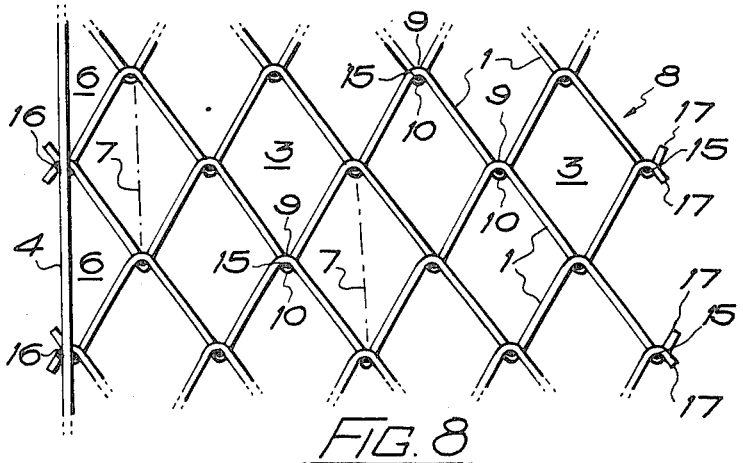
Figure 9:
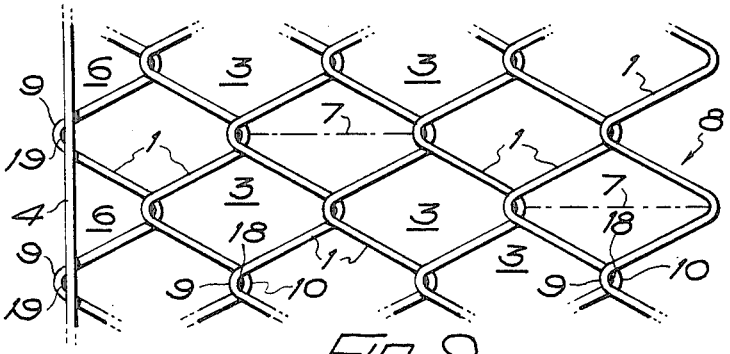
Figure 10:
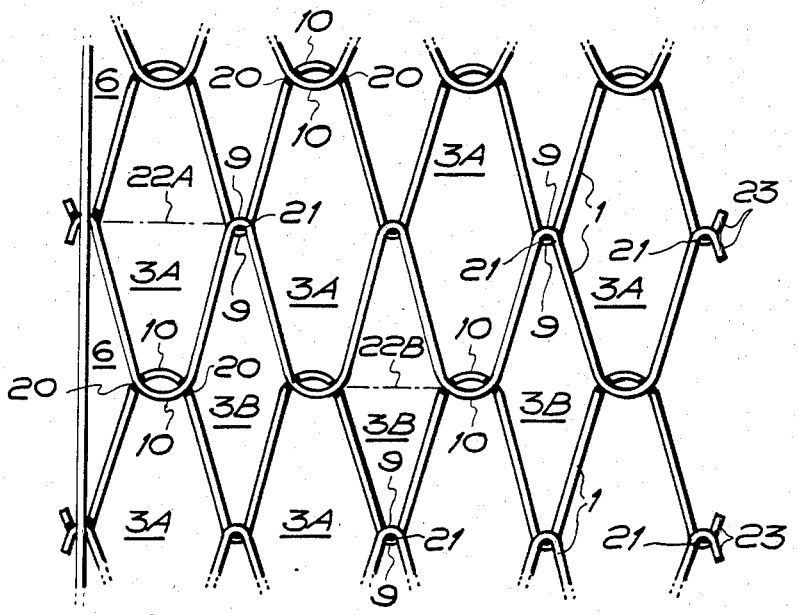
Figure 11:
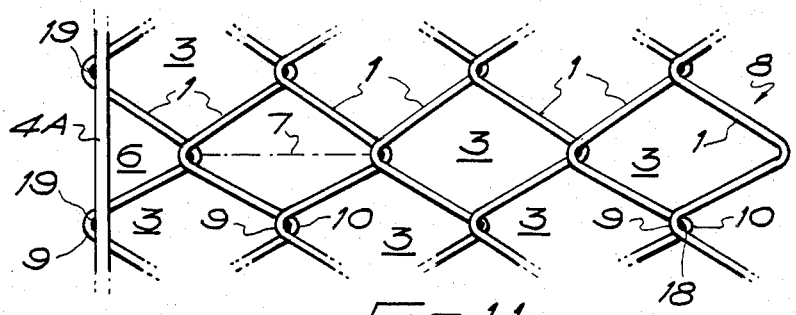

FIG. 3 corresponds to FIG. 1 but shows an alternative angular disposition of the wires inclined to the longitudinal;

FIG. 4 is an enlarged fragmentary section from the line B—B of FIG. 3;

FIG. 5 corresponds to FIG. 1 but shows another angular disposition of the inclined wires;

FIG. 6 is an enlarged fragmentary section from the line C—C of FIG. 5;

FIG. 7 is an elevation of a short length of reinforcing strip in accordance with the invention formed by welding up narrow chain link fencing and including one selvedge wire;

FIG. 8 is an elevation of a short length of reinforcing strip in accordance with the invention formed by welding together transversely extending zig-zag wires and a single selvedge wire;

FIG. 9 corresponds to FIG. 8 but with zig-zag wires running longitudinally;

FIG. 10 corresponds to FIG. 8 but uses a different form of zig-zag wires;

FIG. 11 corresponds to FIG. 9 but shows a larger diameter selvedge wire; and

Figure 12:
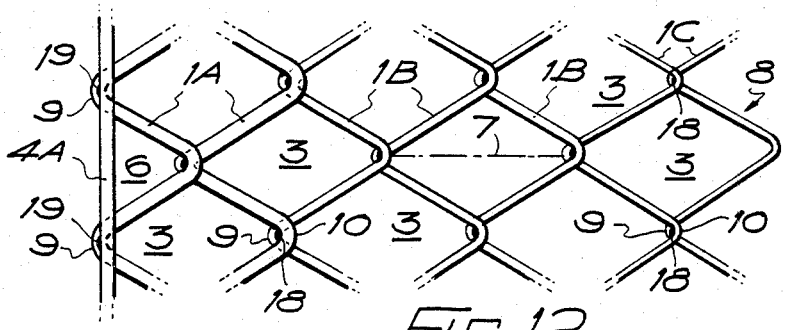

FIG. 12 also corresponds to FIG. 9 but shows three different diameters of wire used for the zig-zags and the selvedge wire.

In FIG. 1 a reinforcing strip consists of straight wires 1 disposed in two parallel series at an angle to each other and also inclined to the longitudinal direction of the strip, the wires being welded at their intersections 2 to form four-sided meshes 3, and a straight selvedge wire 4 running along only one edge of the strip and welded at its intersections 5 with the upper series of wires 1 (see also FIG. 2) to form triangular meshes 6 incapable of being elongated by tension in the longitudinal direction of the strip. The four-sided meshes 3 are diamond-shaped with their longer diagonals 7 disposed longitudinally, and the meshes 3 can elongate differentially from those adjacent the triangular meshes 6 to those adjacent the zig-zag edge 8 remote from the selvedge wire 4 as the strip is wrapped around the frustoconical part of a concrete coating undergoing formation on a pipe (not shown) with the selvedge wire 4 closer to the pipe than the zig-zag edge 8 which elongates under the pull of a pipe coating and winding machine (not shown).

Figure 2:
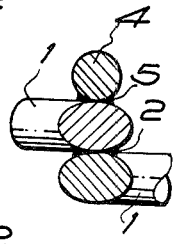
FIG. 2 is an enlarged fragmentary section from the line A—A of FIG. 1.

In FIGS. 3 and 4 like reference numerals represent like parts to those in FIGS. 1 and 2 but in this case the longer diagonals 7 of the diamond-shaped meshes 3 are disposed transversely of the strip, which affords a greater ability to the zig-zag edge 8 to elongate under the pull of a pipe coating and winding machine but means a lesser density of wires 1 in the transverse direction of the strip.

In FIGS. 5 and 6 like reference numerals again represent like parts to the previous Figure, but in this case the four-sided meshes 3 are squares.

In FIG. 7 wires 1 are formed as flattened helices and interengaged (as in chain-link fencing) at their peaks 9 and troughs 10 which are welded together as indicated at 11 to form substantially square meshes 3 having their sides inclined to the longitudinal direction of the strip, and a straight selvedge wire 4 is secured along one edge only by passing it between the adjacent pairs of ends 12 of the zig-zag wires 1, which ends 12 are turned round the selvedge wire 4 and welded thereto as indicated at 13, to form triangular meshes 6 adjacent the selvedge wire incapable of being elongated by tension in the longitudinal direction of the strip. The other pairs of adjacent ends 14 of the zig-zag wires 1 at the zig-zag edge 8 are merely turned round each other, as in the finishing of the edges of chain-link fencing.

In FIG. 8 flat zig-zag wires 1 extend transversely of the strip and have adjacent peaks 9 and troughs 10 overlapped before welding as indicated at 15 to form diamond-shaped meshes 3 with their longer diagonals 7 disposed longitudinally of the strip, and a straight selvedge wire 4 is welded to the peaks 9 along one edge only of the strip as indicated at 16 to form triangular meshes 6, the ends 17 of the zig-zag wires 1 remote from the selvedge wire 4 extending to a negligible extent beyond the adjacent welds 15 to form a zig-zag edge 8.

In FIG. 9 flat zig-zag wires 1 extend longitudinally of the strip and have adjacent peaks 9 and troughs 10 overlapped before welding as indicated at 18 to form diamond-shaped meshes 3 with their longer diagonals 7 disposed transversely of the strip, and a straight selvedge wire 4 is welded to the peaks 9 of one of the end zig-zag wires 1 as indicated at 19 to form triangular meshes 6, while the other end zig-zag wire 1 forms a zig-zag edge 8 of the strip.

In FIG. 10 flat zig-zag wires 1 extend transversely of the strip and have assymmetrical peaks 9 and troughs 10 or vice versa as alternate zig-zags are inverted, and the peaks and troughs of one zig-zag overlap the troughs and peaks respectively of adjacent zig-zags before welding, but the "blunter" troughs (and peaks) 10 are overlapped to such an extent as to require welding at two intersections 20 each, whereas the "sharper" peaks (and troughs) 9 only require one weld 21. The result is substantially diamond-shaped meshes 3A, 3B with their longer "diagonals" extending longitudinally of the strip and all of the same length, while their shorter diagonals 22A, 22B respectively extend transversely of the strip and differ in length. A straight selvedge wire is welded to the "sharper" peaks 9 at one edge only of the strip to form triangular meshes 6, the adjacent pairs of ends 23 of the zig-zag wires 1 remote from the selvedge wire 4 extending to a negligible extent beyond the adjacent welds 21 to form a zig-zag edge 8.

In FIG. 11 like reference numerals represent like parts to those shown in FIG. 9 except that the straight selvedge wire 4A is of a larger diameter than the zig-zag wires 1, while in FIG. 12 like reference numerals again represent like parts to those shown in FIGS. 9 and 11 except that the larger selvedge wire 4A has the same diameter as the wires 1A of the adjacent pair of zig-zags, which have a greater diameter than the wires 1B of the next three zig-zags, while the last pair of zig-zag wires 1C remote from the selvedge wires 4A have a lesser diameter than the wires 1B, so as to reduce the pull required in the pipe coating and winding machine to stretch the meshes 3 in the lengthwise direction of the strips to progressively greater extents from the selvedge wire 4 to the other edge of the strip.

I claim:

1. A reinforcing strip comprising wires welded together to form four-sided meshes having sides inclined to the longitudinal direction of the strip, and a straight selvedge wire welded thereto to form along only one edge of the strip triangular meshes incapable of being elongated by tension in the longitudinal direction of the strip.

2. A reinforcing strip as in claim 1, wherein the four-sided meshes are diamond-shaped.

3. A reinforcing strip as in claim 2, wherein the diamond-shaped meshes have their longer diagonals disposed longitudinally of the strip.

4. A reinforcing strip as in claim 2, wherein the diamond-shaped meshes have their longer diagonals disposed transversely of the strip.

5. A reinforcing strip as in claim 1, wherein the four-sided meshes are squares.

6. A reinforcing strip as in any one of claims 1, 2, 3, 4, or 5 and formed of welded mesh without twists.

7. A reinforcing strip as in any one of claims 1, 2, 3, 4, or 5, wherein the wires forming the four-sided meshes are formed as zig-zags and welded to each other at adjacent peaks and troughs.

8. A reinforcing strip as in claim 7, wherein the zig-zags extend longitudinally of the strip.

9. A reinforcing strip as in claim 7, wherein the zig-zags extend transversely of the strip.

10. A reinforcing strip as in claim 9, wherein the zig-zags are formed as flattened helices and interengaged before welding adjacent peaks and troughs and welding to the selvedge wire.

11. A reinforcing strip as in claim 7, wherein the zig-zags are formed in one plane.

12. A reinforcing strip as in claim 11, wherein adjacent peaks and troughs overlap slightly.

13. A reinforcing strip as in claim 7, wherein the selvedge wire is of a different diameter to that of the wires forming the four-sided meshes.

14. A reinforcing strip as in claim 8, wherein the wires forming the meshes are of different diameters.

15. A reinforcing strip as in claim 14, wherein the wire or wires remote from the selvedge are of smaller diameter than the wire adjacent the selvedge wire.

* * * * *